United States Patent [19]

Nakajima et al.

[11] Patent Number: 4,875,844

[45] Date of Patent: Oct. 24, 1989

[54] SPINNERET ASSEMBLY FOR SHEATH-CORE TYPE COMPOSITE FIBERS

[75] Inventors: Sadaaki Nakajima; Taiju Terakawa, both of Shiga, Japan

[73] Assignee: Chisso Corporation, Osaka, Japan

[21] Appl. No.: 310,585

[22] Filed: Feb. 15, 1989

[30] Foreign Application Priority Data

Feb. 17, 1988 [JP] Japan ..... 63-32789

[51] Int. Cl.[4] ..... D01D 4/06

[52] U.S. Cl. ..... 425/131.5; 264/171; 425/192 S; 425/463; 425/DIG. 217

[58] Field of Search ..... 425/131.5, DIG. 217, 425/191 S, 192, 382.2, 463, 131.1, 192 S, 72 S; 264/171

[56] References Cited

U.S. PATENT DOCUMENTS

| | | | |
|---|---|---|---|
| 2,440,761 | 5/1948 | Sisson et al. | 425/DIG. 217 |
| 2,987,797 | 6/1961 | Breen | 428/370 |
| 3,584,339 | 6/1971 | Kamachi et al. | 425/131.5 |
| 3,613,170 | 10/1971 | Soda et al. | 264/171 |
| 3,814,561 | 6/1974 | Matsui et al. | 425/463 |
| 3,849,044 | 11/1974 | Ando et al. | 425/131.5 |
| 4,052,146 | 10/1977 | Sternberg | 425/463 |
| 4,717,325 | 1/1988 | Fujimura et al. | 425/131.5 |

*Primary Examiner*—Jay H. Woo
*Assistant Examiner*—K. P. Nguyer
*Attorney, Agent, or Firm*—Oblon, Spivak, McClelland, Maier & Neustadt

[57] ABSTRACT

A sheath-core type composite spinneret assembly includes in combination:

(1) an annular array of multiple spinning holes provided in at least one row, (2) a spinning-stock-solutions-combining-passage being in the form of an endless annulus per the annular array of one row of the spinning holes and on which inlets of the spinning holes are open, (3) a single core-component-stock-solution-distributing-passage in the annular form; core-component-stock-solution-outlet-passages provided from the core-distributing-passage to the solutions-combining-passage; two sheath-component-stock-solution-distributing-passages, both in the annular form, sandwiching the core-distributing-passage; and sheath-component-stock-solution-outlet-passages provided from the shealth-distributing-passages to the solutions-combining-passage and open on both side edges of the solutions-combining-passage at positions located substantially in the middle of the adjacent inlets of the holes, and (4) a core- and sheath-component-stock-solution-feeding-passage provided to individually feed the core- and shealth-component-stock-solutions to the core- and sheath-distributing-passage, respectively.

4 Claims, 7 Drawing Sheets

SPINNERET ASSEMBLY FOR SHEATH-CORE TYPE COMPOSITE FIBERS

BACKGROUND OF THE INVENTION

1. Field of the Invention

The present invention relates to a spinneret assembly capable of spinning sheath-core type composite fibers in which the ratio of core component to the sheath component is uniform from a single fiber to another and the core positions are constant.

2. Statement of the Prior Art

A number of spinneret assemblies for obtaining fibers of the sheath-core composite structure from two types of spinning stock solutions have heretofore been known in the prior art. Composite fibers have been spun out of a number of spinning holes open on a spinning plane of such spinneret assemblies. However, little or no attention has been paid to the elimination of ununiformity in the composite structure among fibers, which would result from the location of the spinning holes and the arrangement of the passages through which stock solutions are fed to the spinning holes. One example of such conventional spinneret assemblies is dislcosed in Japanese Patent Publication No. 62-37126, and will now be explained with reference to the drawings. FIG. 12 is a partly omitted, sectional view showing the conventional spinneret assembly, FIG. 13 is a plan view of a first distributor used in the assembly of FIG. 12, and FIG. 14 is a plan view of a second distributor used therein.

In the conventional spinneret assembly shown generally at 1, a stack of a spinneret plate 2, a second distributor 3, a first distributor 4, a filter 5 and a cap 6 are housed in that order from below within a casing 7, as illustrated in FIG. 12, with a gap 8 being provided between the spinneret plate 2 and the second distributor 3 along their full length. In an upper plane of the second-distributor 3, there are an alternate and parallel arrangement of core-component-stock-distributing-grooves **3*a* and sheath-component-stock-solution-distributing-grooves 3*b*, as illustrated in FIG. 14. The first-distributor 4 superposed on the second-distributor 3 (i.e., FIG. 13 being superposed on FIG. 14 as such and without changing direction) and shown in FIG. 13 includes core-component-stock-solution-inlet-holes 4*a* and sheath-component-stock-solution-inlet-holes 4*b* to which core- and sheath-component-stock-solutions are separately fed through the filter 5 for introduction into the distributing-grooves 3*a* and 3*b* in the second-distributor 3. The core- and sheath-component-stock-solutions introduced into the distributing-grooves 3*a* and 3*b* are guided to the gap 8 through the associated holes 3*c* and 3*d* for regulating the pressures of both component-stock-solutions respectively. In the gap 8, spinning holes 2*a* are open at positions coaxial with respect to the holes 3*c* for regulating the pressure of the core-component-stock-solution, so that the core-component-stock-solution is forced substantially straight into the spinning-holes 2*a* while is surrounded by the sheath-component-stock-solution, and spun out of the spinning plane. In the structure of such a spinneret assembly according to the prior art, the holes 3*d* for regulating the pressure of the sheath-component-stock-solution in the second-distributor 3 are located at the apexes of a rectangle, and the hole 3*c* for regulating the pressure of the core-component-stock-solution is located at the center of said rectangle, as shown by a dotted chain line in FIG. 14, whereby the distances of the sheath-component-stock-solution flowing in one spinning hole 2*a* from the holes 3*d* are designed to be equalized to make uniform the thickness of the sheath component surrounding the core component. In this respect, this structure is effective. However, even when the holes 3*c* and 3*d* and the spinning holes 2*a* are located as described above, there is a difference in the composite structures between the fiber spun out of the spinning holes 2*a* located at the ends and the fiber spun out of the holes at the center of the array of the spinning holes. That is, the sheath-component-stock-solution is uniformly fed to the central spinning hole 2*a* from its surrounding four holes 3*d* (in this case, one hole 3*d* serves to feed the stock solution to four spinning holes 2*a*), whereas a large amount of the sheath-component-stock-solution is fed to the endmost spinning hole 2*a* from two holes 3*d* (due to the fact that one hole 3*d* serves to feed the stock solution to one or two spinning holes 2*a* alone), so that the ratio of the sheath component to the core component in the composite structures spun out is larger in the endmost holes 2*a* than in the central hole 2*a*. In this case, not only is the sheath/core ratio different, but the core positions are also eccentric toward the sheath component being reduced. Even though the illustrated array of spinning holes 2*a*** is changed to a circular one, the aforesaid disadvantage is unavoidable, as long as the construction of the passages for feeding the stock solutions is principally identical.

SUMMARY OF THE INVENTION

The present invention has for its object to eliminate the defects of the prior art by the provision of a spinneret assembly capable of spinning sheath/core type composite fibers in which the sheath/core ratio is uniform through fibers and the core positions are constant.

According to the present invention, this object is achieved by providing annular arrays of spinning holes and forming per one annular array of spinning holes an endless annular passage in which two core-and sheath-component-stock-solutions are combined with each other for flowing thereinto.

DETAILED EXPLANATION OF THE INVENTION

Figure 1:
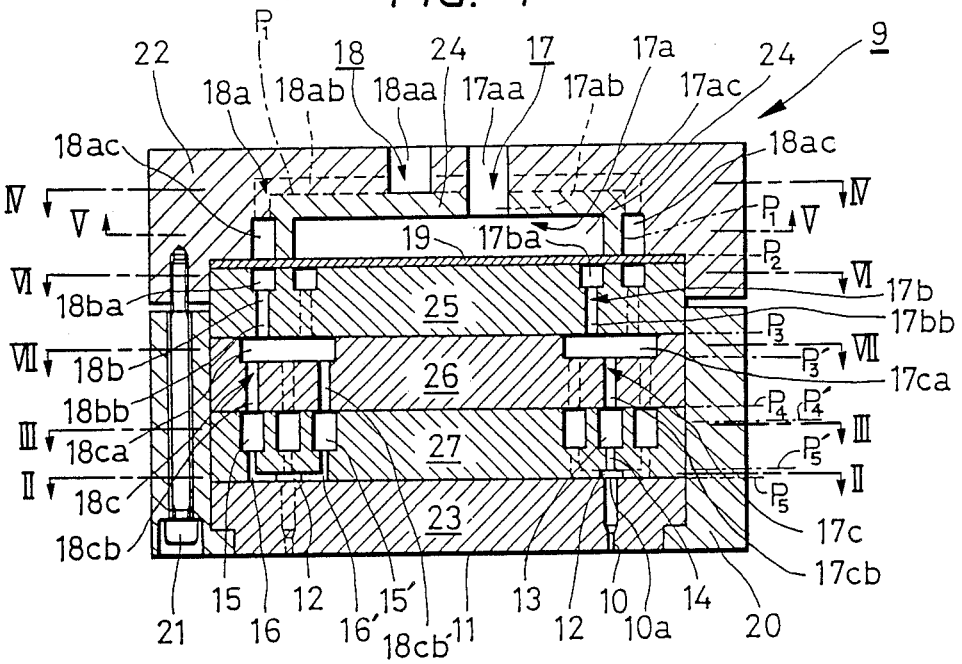
FIG. 1 is a view illustrating one embodiment of the present invention using one annular array of spinning holes, which is sectioned by a plane vertical with respect to a spinning plane and extending through three points defined by one spinning hole and the center of said annular array and located midway between the adjacent spinning holes on the side opposite to said center.

Referring now to FIG. 1, one embodiment of the sheath-core type composite spinneret assembly (which may hereinafter be simply called as the spinneret assembly) is generally shown by reference numeral 9, and includes the parts or members to be described successively as below.

Figure 2:
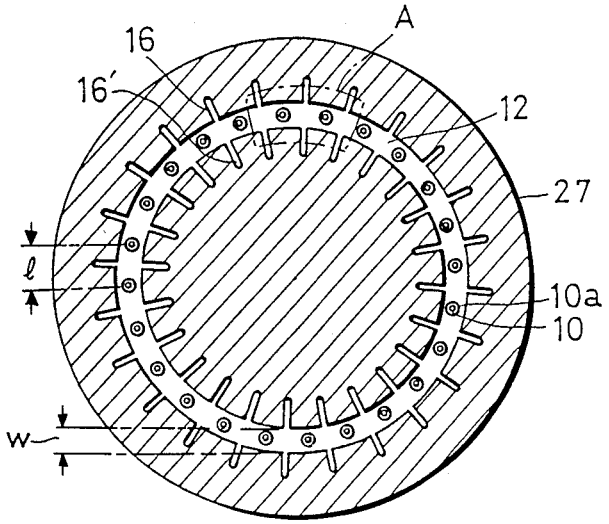
FIG. 2 is a sectional view taken along the line II—II of part of FIG. 1.
Figure 10:
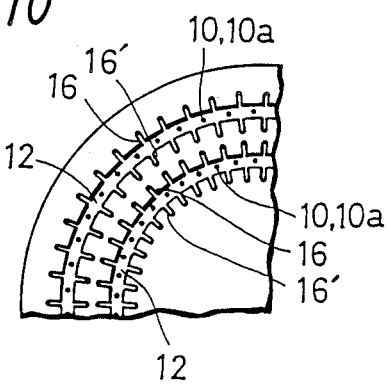

(1) An annular array of spinning holes 10 are open on a spinning plane 11 of the spinneret assembly 9 and arranged at equiangular intervals, as illustrated in FIGS. 1 and 2. As illustrated in FIG. 2, the annular array of spinning holes 10 should be provided in at least one row. However, they may be provided in two or three or more rows, as illustrated in FIG. 10. Each spinning hole 10 may be of a round shape or other shapes such as a triangle in section.

Figure 9:
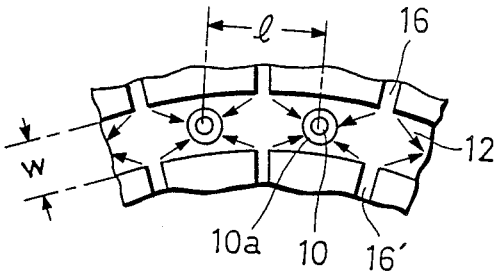
FIG. 9 is an enlarged view showing a portion shown at A in FIG. 2, and FIGS. 10 and 11 are partly sectional views illustrative of another embodiment of the present invention and corresponding to FIGS. 2 and 3, respectively.

(2) As illustrated in FIG. 2, reference numeral 12 indicates a spinning-stock-solutions-combining-passage (hereinafter simply referred to as solutions-combining-passage; hereinafter, simple name is shown in parentheses in same way as this) in the form of an endless annulus, which, as illustrated in FIG. 1, is provided per one row of said spinning holes and arranged on the spinning-stock-solution-feeding-side of said spinning holes and in parallel with the spinning plane 11 and is of a shallow depth, and in which spinning-stock-solution-inlets (inlet) 10*a* of the respective spinning holes 10 are open. It is preferred that the width w of the solutions-combining-passage 12 be 0.5 to 2.0 times as large as the pitch l of the spinning holes 10 (w and l also indicated in FIG. 9), and the depth thereof be about 0.2 to 1.0 time as large as the sectional diameter of a core-component-stock-solution-outlet-passage 14 (to be described later) of a circle in section (or the longitudinal diameter of the passage 14 of other shapes in section)

Figure 3:
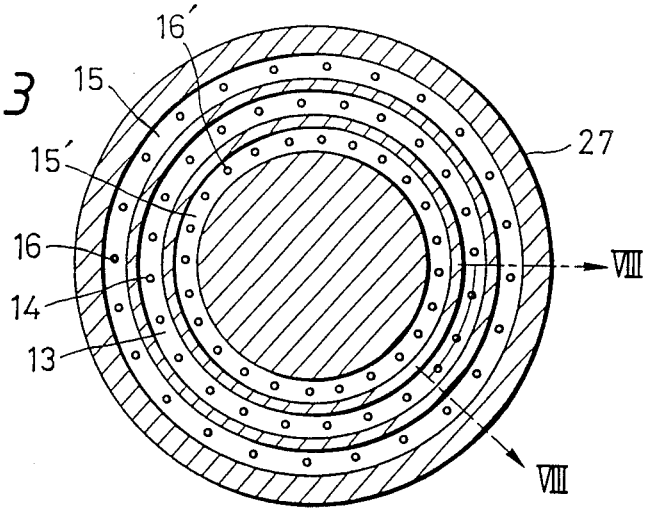
FIG. 3 is a sectinal view taken along the line III—III of part of the FIG. 1.

(3) As illustrated in FIGS. 1 and 3, a single annular passage 13 for distributing the core-component-stock-solution, being called a core-component-stock-solution-distributing-passage (core-distributing-passage), is arranged on the spinning-stock-solution-feeding-side along the solutions-combining-passage 12. The core-component-stock-solution-outlet-passage (core-outlet-passage) 14 are provided so as to guide the core-component-stock-solution from the core-distributing-passage 13 to the solutions-combining-passage 12 and then to the inlets 10*a* of the spinning holes 10 which are open in the solutions-combining-passage 12. The core-outlet-passages 14 are located at positions coaxial or eccentrical with respect to the respective spinning holes 10 as illustrated in FIG. 1 as to the former case, and are open in the solutions-combining-passage 12 at said positions. When the core-outlet-passages 14 are provided at positions eccentrical with respect to the spinning holes 10, such positions should preferably be selected in such a manner that no part of the core-outlet-passage 14 depart axially from the inlets 10*a* of the spinning holes 10. Each core-outlet-passage-14 may be of a circle or other shapes in section. As illustrated in FIGS. 1 and 3, two sheath-component-stock-solution-distributing-passages (sheath-distributing-passage) 15 and 15', both in the annular form, are arranged in parallel with the spinning plane 11 with the core-distributing-passage 13 being sandwiched therebetween. Sheath-component-stock-solution-outlet-passages (sheath-outlet-passage) 16 and 16' are provided to guide the sheath-component-stock-solution from the sheath-distributing-passages 15 and 15' to the solutions-combining-passage 12 and, as illustrated in FIG. 2, are open on both edges of the solutions-combining-passage 12 at positions located substantially in the middle of the adjacent inlets 10*a* of the spinning holes 10. The sheath-outlet-passages 16 and 16' may preferably be open substantially vertically with respect to the side edges of the solutions-combining-passage 12. More preferably, in order to facilitate the making of this assembly, they extend vertically from the sheath-distributing-passages 15 and 15' to the spinning plane 11, then run in parallel with the spinning plane 11, and finally reach the solutions-combining-passage 12, as illustrated in FIG. 1. The core-distributing-passage 13 and the sheath-distributing-passages 15 and 15' each take on an annular form so as to guide the spinning stock solutions to the solutions-combining-passage 12 in the endless annular form.

(4) A core-component-stock-solution-feeding-passage (core-feeding-passage) 17 and a sheath-component-stock-solution-feeding-passage (sheath-feeding-passage) 18 are provided to independently feed the core-component-stock-solution and the sheath-component-stock-solution to the core-distributing-passage 13 and the sheath-distributing- passages 15 and 15', respectively. The constructional embodiment will now be explained, by way of example alone, with reference to FIGS. 1 and 4 to 7.

Figure 4:
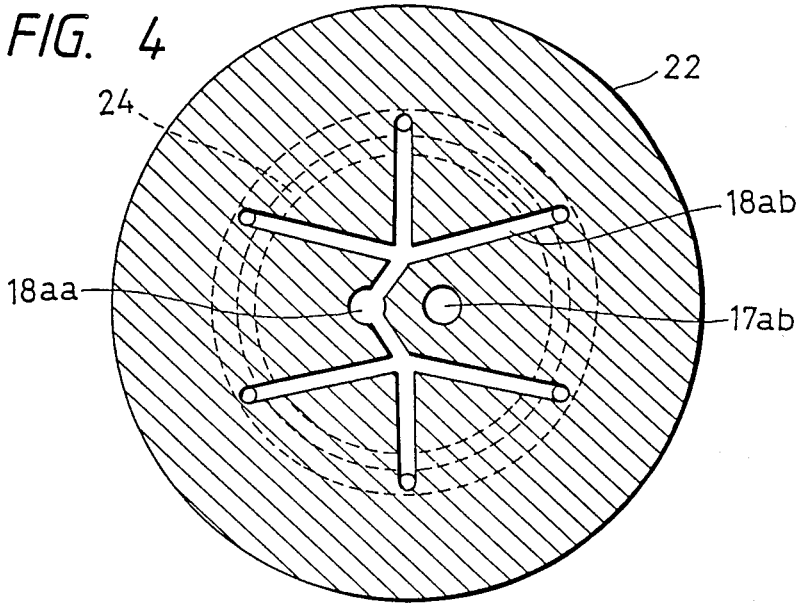
FIG. 4 is a sectional view taken along the line IV—IV of FIG. 1.
Figure 5:
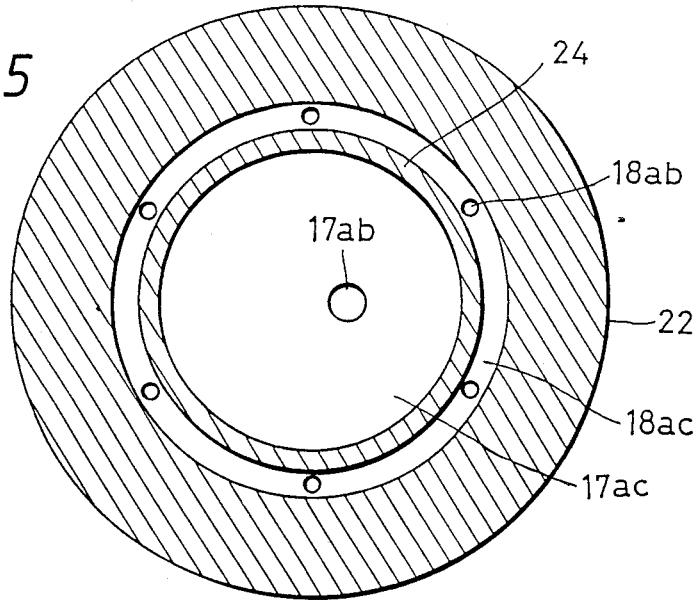
FIG. 5 is a sectional view taken along the line V—V of FIG. 1.

As illustrated in FIG. 1, a core-component-stock-solution-feeding-inlet (core-feeding-inlet) 17*aa*, a first-core-component-stock-solution-passage (first-core-passage) 17*ab* and a core-component-stock-solution-pre-filtration-chamber (core-pre-filtration-chamber) 17*ac* are provided for the core-component-stock-solution and allowed to communicate with one another, while a sheath-component-stock-solution-feeding-inlet (sheath-feeding-inlet) 18*aa*, a first-sheath-component-stock-solution-passage (first-sheath-passage) 18*ab* and a sheath-component-stock-solution-pre-filtration-chamber (sheath-pre-filtration-chamber) 18*ac* are provided for the sheath-component-stock-solution and permitted to communicate with one another. As illustrated in FIG. 5, the core-pre-filtration-chamber 17*ac* and the sheath-pre-filtration-chamber 18*ac* are such that one has an circular contour and is located in the middle, while the other concentrically surrounds the one with both the lower ends being located in the same plane parallel with the spinning plane 11. Thus these above-mentioned are defining a first-core-component-stock-solution-feeding-passage-section (first-core-feeding-passage-section) 17*a* and a first-sheath-component-stock-solution-feeding-passage-section (first-sheath-feeding-passage-section) 18*a*, respectively. Reference will now be made to the illustrated configuration wherein the core-pre-filtration-chamber 17*ac* is located in the middle and surrounded by the sheath-pre-filtration-chamber 18*ac*. However, both chambers may be reversed in their positions. As illustrated, the centrally located core-pre-filtration-chamber 17*ac* is defined by an cylindrical cavity for its easy making, but it may be in the annular form. As illustrated in FIG. 4, the first-sheath-passage 18*ab* comprises a number of branched sub-passages so as to feed the sheath-component-stock-solution as uniformly as possible throughout the sheath-pre-filtration-chamber 18*ac*, and is selectively located in a position which does not intersect the first-core-passage 17*ab*. It is to be appreciated that for a better understanding, said portion of FIG. 1 is depicted in such a fashion that confusions brought about by making it precisely correspondent to FIGS. 4 and 5 are avoided.

Figure 6:
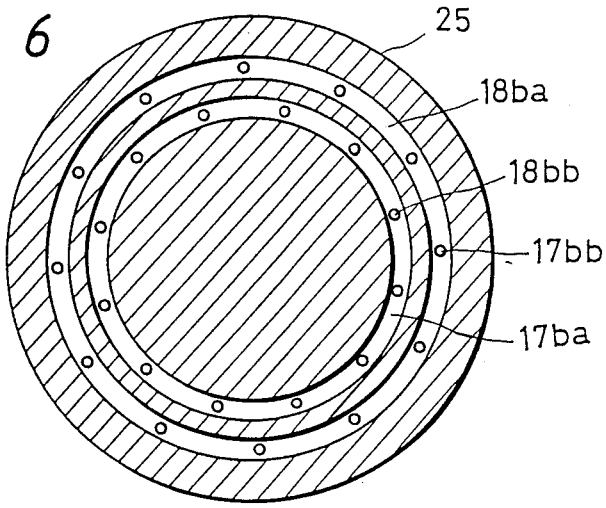
FIG. 6 is a sectional view taken along the line VI—VI of part of FIG. 1.

As illustrated in FIG. 1, the core-pre-filtration-chamber 17*ac* and the sheath-pre-filtration-chamber 18*ac* are connected through a filter 19 with a core-component-stock-solution post-filtration chamber (core-post-filtration-chamber) 17*ba* and a sheath-component-stock-solution-post-filtration-chamber (sheath-post-filtration-chamber) 18*ba*, respectively, both being in the annular form as depicted in FIG. 6, which are in turn connected with a plurality of second-core-component-stock-solution-passages (second-core-passage) 17*bb* and second-sheath-component-stock-solution-passages (second-sheath-passages) 18*bb* to guide the core- and sheath-component-stock-solutions to the next feeding passages and arranged in the manner to be described later, thus defining a second-core-component-stock-solution-feeding-passage-section (second-core-feeding-passage-section) 17*b* and a second-sheath-component-stock-solution-feeding-passage-section (second-sheath-feeding-passage-section) 18*b*. The second-core-passages 17*bb* and the second-sheath-passage 18*bb* are arranged at positions extending radially from the center of the annulus and not overlapping with one another, preferably at alternate and equiangular positions.

Figure 7:
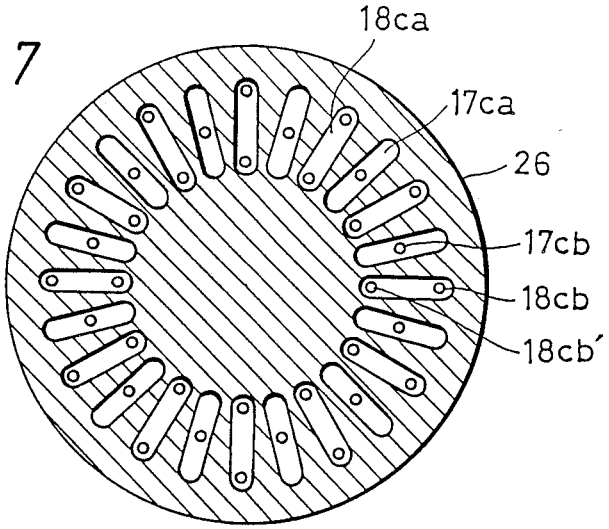
FIG. 7 is a sectional view taken along the line VII—VII of part of FIG. 1.

As illustrated in FIG. 1, said second-core-passage 17*bb* and said second-sheath-passage 18*bb* are then connected with a core-component-stock-solution-receiving-small-chamber (core-small-chamber) 17*ca* and a sheath-component-stock-solution-receiving-small-chamber (sheath-small-chamber) 18*ca*, as shown in FIG. 7, for receiving the core- and sheath-component-stock-solutions, respectively, which are in turn connected with a core-component-stock-solution-inlet-passage (core-inlet-passage) 17*cb* and sheath-component-stock-solution-inlet-passages (sheath-inlet-passage) 18*cb*/18*cb*′ to introduce the core- and sheath-component-stock-solutions into aforesaid core-distributing-passage 13 and aforesaid sheath-distributing-passages 15 and 15′, respectively, thus defining a third-core-component-stock-solution-feeding-passage-section (third-core-feeding-passage-section) 17*c* and a third-sheath-component-stock-solution-feeding-passage-section (third-sheath-feeding-passage-section) 18*c*. Although each sheath-small-chamber 18*ca* should be of a length sufficient to have two openings of the sheath-inlet-passages 18*cb* and 18*cb*′ corresponding to the two sheath-distributing-passages 15 and 15′ as illustrated in FIG. 7, each core-small-chamber 17*ca* need not be of the same length as the sheath-small-chamber 18*ca*, as illustrated.

Said first- to third-core-feeding-passage-sections 17*a* to 17*c* and said first- to third-sheath-feeding-passage-sections 18*a* to 18*c* provide the successive core-feeding-passage 17 and the successive sheath-feeding-passage 18, respectively.

Figure 11:
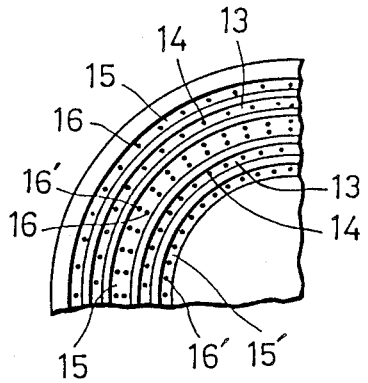
Figure 12:
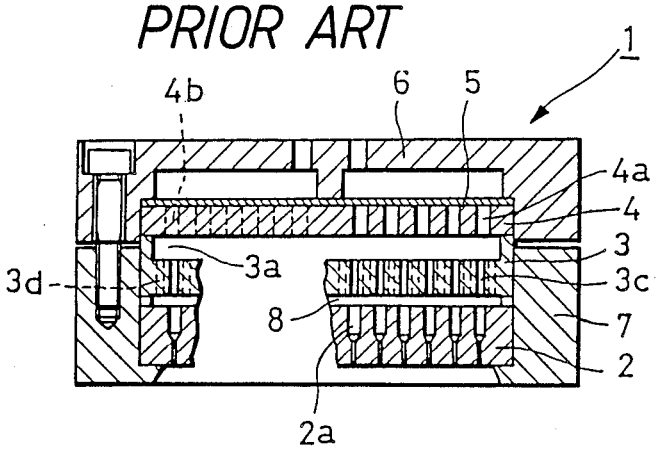
FIG. 12 PRIOR ART
Figure 13:
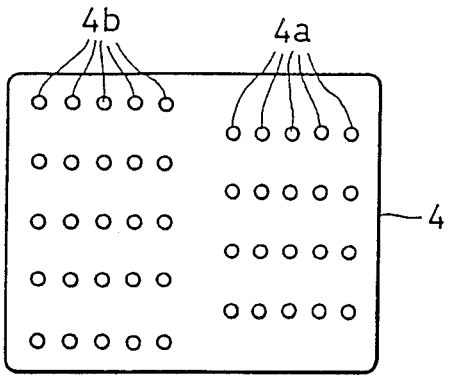
FIG. 13 PRIOR ART
Figure 14:
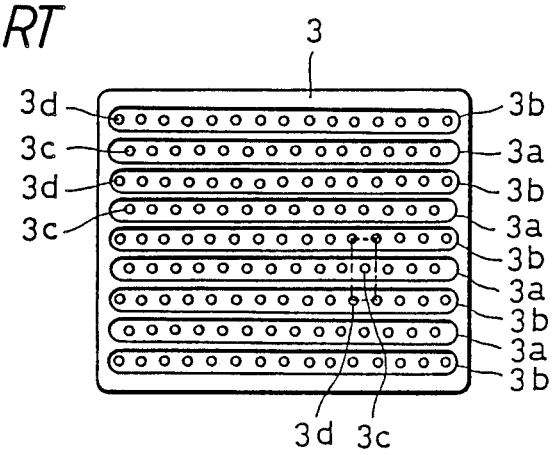
FIG. 14 PRIOR ART

When the annular array of spinning holes 10 are provided in plural rows, said structure may be repeated in the radial direction of the annulus. In the case of two rows, for instance, the solutions-combining-passage 12, the sheath-outlet-passages 16 and 16′, the spinning holes 10 and the like may be disposed as illustrated in FIG. 10. The core-distributing-passage 13, the core-outlet-passage 14, the sheath-distributing-passages 15, 15′ and the sheath-outlet-passages 16, 16′ may likewise be repeated while made correspondent to the rows of the spinning holes. As illustrated in FIG. 11, it is preferred in this case that, of the two sheath-distributing-passages 15 (outer) and 15′ (inner) provided on both sides of each of the inner and outer spinning rows (the adjacent spinning hole rows in the case of three or more rows), the sheath-distributing-passage 15′ on inner side of the outer spinning holes row and the sheath-distributing-passage 15 on outer side of the inner spinning holes row be formed into a common single sheath-distributing-passage 15 of a large width, since it is then possible to simplify the arrangement and decrease the required volume, thus making assembling easy. In the third core-feeding-passage-section 17*c* and the third sheath-feeding-passage-section 18*c*, the core-small-chambers 17*ca* and the sheath-small-chambers 18*ca* are radially extended so as to make connections to the core- and sheath-inlet-passages 17*cb* and 18*cb*/18*cb*′ correspondingly required to the increased core- and sheath-distributing-passages 13 and 15 (15′).

The spinneret assembly 9 according to the present invention is constructed by including the portions described in the foregoing (1) to (4) as the characteristic ones.

As illustrated in FIG. 1, a stack of a plurality of members and the filter 19 within a casing 20 is fastened by bolts 21 to a spinneret assembly 9, said members being obtained by splitting or dividing the construction comprising the portions as described in (1) to (4) along several proper planes. How to divide the construction is dependent upon at least the possibility with which the members are made and, preferably, the easiness with which the members are made and assembled into a unit. Ordinarily, the uppermost-stage member is called a cap 22, while the lowermost-stage member including the spinning holes 10 is referred to as a spinneret plate 23. One exampale of such division is shown in FIG. 1. In FIG. 1, the cap 22, a first distributor 24 located therebelow (hereinafter named in same manner), a second distributor 25, a third distributor 26, a fourth distributor 27 and the spinneret 23 are successively divided by planes $P_1$, $P_2$, $P_3$, $P_4$ and $P_5$. For instance, the first sheath passage 18*ab* is defined by a groove formed by scraping off on the side of the cap 22 and the plate plane of the first distributor 24 by division with the plane $P_1$. Other chambers, inlet- and outlet-passages, distributing-passages, solutions-combining-passage, etc. will likewise be appreciated from FIG. 1. In the foregoing example of division, a combination of the cap 22 and the first distributor 24 is provided with the first-core- and sheath-feeding-passage-sections 17*a* and 18*a*; the second distributor 25 with the second-core- and sheath-feeding-passage-sections 17*b* and 18*b*; the third distributor 26 with the third-core- and sheath-feeding-passage-sections 17*c* and 18*c*; the fourth distributor 27 with the core- and sheath-distributing-passages 13, 15 and 15′ to the solutions-combining-passage 12; and the spinneret plate 23 with the spinning holes 10. In another aspect of division, as also illustrated in FIG. 1 as an example, division is made by planes $P_3'$, $P_4'$ and $P_5'$ in place of the planes $P_3$, $P_4$ and $P_5$.

Figure 8:
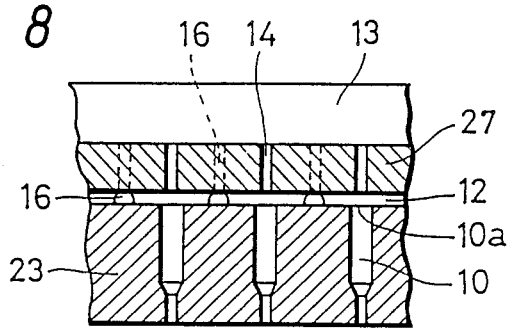
FIG. 8 is an enlarged sectional view taken along the line VIII'VIII of FIG. 3.

As the core- and sheath-component-stock-solutions are fed under pressure through the respective core- and sheath-feeding-inlets 17*aa* and 18*aa*, the former passes through the core-feeding-passage 17 into the core-distributing-passage 13, while the latter passes through the sheath-feeding-passage 18 into the sheath-distributing-passages 15 and 15′. When the core-outlet-passage 14 following the core-distributing-passage 13 is located coaxially with respect to the spinning holes 10, as illustrated in FIG. 8, the core-component-stock-solution passes through the solutions-combining-passage 12 and is fed in a straight line into the centers of the spinning holes 10. On the other hand, the sheath-component-stock-solution is guided from the sheath-outlet-passages 16 and 16', and flows, as shown by an arrow in FIG. 9, into the spinning holes 10 in such a manner that the core-component-stock-solution is wrapped therein. In this case, since all the sheath-outlet-passages 16 and 16' are open in the solutions-combining-passage 12 at the positions located substantially in the middle of the inlets 10*a* of the spinning holes 10, each of those sheath-outlet-passages 16 and 16' serves to equally feed the sheath-component-stock solution into two spinning holes 10. At the same time, since the inlet 10*a* of one spinning hole 10 is equally spaced away from the openings in the four sheath-outlet-passages 16 and 16', the core-component-stock-solution is wrapped in the sheath-component-stock-solution with a uniform thickness, so that sheath-core type composite fibers having their cores disposed centrally in section are obtained. The sides of a substantial rectangle defined by the openings of the four sheath-outlet-passages 16 and 16' surrounding one spinning hole 10 are w and l in length, as known from FIG. 9. When w is 0.2 to 2.0 times as large as l, there is a sufficient increase in the uniformity of the sheath-component-stock-solution in which the core-component-stock-solution flowing into the spinning hole 10 is wrapped from all directions. When the core-outlet-passages 14 are diposed eccentrially with respect to the spinning holes 10, there are obtained the socalled eccentric core type fibers having their cores disposed eccentrially in section, since the core-component-stock-solution flows eccentrially into the spinning holes 10, so that it is wrapped in the sheath-component-stock-solution with an irregular thickness.

Whether the sheath-core type or the eccentric core type, what is important to obtain a composite structure is that the inflow state of both spinning-component-stock-solutions from the solutions-combining-passage 12 to the spinning holes 10 is equalized throughout all the spinning holes 10 because of the solutions-combining-passage 12 being in the form of an endless annulus, so that the composite structures of the resulting composite fibers are uniform in all respects.

When a mulitiplicity of spinning hole rows are arranged at close intervals to increase the number of the spinning holes 10, it is required to reduce the width of the solutions-combining-passage 12, core-distributing-passage 13 and sheath-distributing-passages 15 and 15'. However, for reason of their annular form and by disposing the core- and sheath-inlet-passages 17*cb* and 18*cb* at properly close spacings as viewed in the circumferential direction, it is possible to make the flows of the stock solutions substantially uniform over the entire circumference, so that the fibiers obtained from all the spinning holes 10 are of a uniform composite structure.

According to the sheath-core type composite spinneret assembly of the present invention, the spinning-stock-solutions-combining-passage in the form of an endless annulus is provided per one annular array of the spinning holes so as to combine together the core- and sheath-component-stock-solutions just before the spinning holes, and the sheath-component-stock-solution-outlet-passages are uniformly arranged and made open, whereby the composite structures spun out of all the spinning holes are made so uniform that the sheath-core type composite fibers can be spun, in which the ratio of the core component to the sheath component is uniform all through fibers and the core positions are constant. It is also possible to increase the number of the spinning holes while such composite structures are kept uniform.

What is claimed is:

1. A sheath-core type composite spinneret assembly (9) comprising in combination:

(1) an annular array of multiple spinning holes (10) which are provided at least in one row and open on a spinning plane (11) of said spinneret assembly (9), (2) a spinning-stock-solutions-combining-passage (12) in the form of an endless annulus, which is of a shallow depth and provided on its spinning-stock-solution-feeding-side of said spinning holes (10) and in parallel with said spinning plane (11) per one row of said array of said spinning holes (10), and on which inlets (10*a*) of said spinning holes (10) are open, (3) a single core-component-stock-solution-distributing-passage (13) in the annular form arranged along said spinning-stock-solutions-combining-passage (12) on its spinning-stock-solution-feeding-side; core-component-stock-solution-outlet-passages (14) provided to guide a core-component-stock-solution from said core-component-stock-solution-distributing-passage (13) to said spinning-stock-solutions-combining-passage (12) and open in said spinning-stock-solutions-combining-passage (12) at positions located coaxially with respect to said spinning holes (10); two sheath-component-stock-solution-distributing-passages (15, 15'), both in the annular form, arranged in parallel with said spinning plane (11) with said core-component-stock-solution-distributing-passage (13) being sandwiched therebetween; and sheath-component-stock-solution-outlet-passages (16, 16') provided to guide a sheath-component-stock-solution from said sheath-component-stock-solution-distributing-passages (15, 15') to said spinning-stock-solutions-combining-passage (12) and respectively open on both side edges of said spinning-stock-solutions-combining-passage (12) at positions located substantially in the middle of the adjacent inlets (10*a*) of said holes (10), and (4) a core-component-stock-solution-feeding-passage (17) and a sheath-component-stock-solution-feeding-passage (18) provided to individually feed said core- and sheath-component-stock-solution to said core-component-stock-solution-distributing-passage (13) and said sheath-component-stock-solution-distributing-passages (15, 15').

2. A spinneret assemby (9) as recited in claim 1, wherein said array of said spinning holes (10) are provided in plural rows, and, of said two sheath-component-stock-solution-distributing-passages (15, 15') provided on both sides of each of the adjacent inner and outer spinning hole rows, the sheath-component-stock-solution-distributing-passage (15') on inner side of the outer spinning hole row and the sheath-component-stock-solution-distributing-passage (15) on outer side of the inner spinning hole row are common to each other.

3. A spinneret assembly (9) as recited in claim 1 or 2, wherein said core-component-stock-solution-outlet-passages (14) are eccentric with respect to said spinning holes (10).

4. A spinneret assembly (9) as recited in claim 1 or 2, wherein the width (w) of said spinning-stock-solutions-combining-passage 12 is 0.5 to 2.0 times as large as the pitch (l) of said spinning holes (10).

* * * * *